US008529090B2

(12) United States Patent
Liou et al.

(10) Patent No.: US 8,529,090 B2
(45) Date of Patent: Sep. 10, 2013

(54) INDEPENDENTLY DETACHABLE LIGHT-EMITTING DIODE LIGHT SOURCE MODULE

(75) Inventors: Yuan-Chang Liou, Nantou County (TW); Ching-Miao Lu, Taipei (TW)

(73) Assignee: Ching-Miao Lu, Taipei (TW)

( * ) Notice: Subject to any disclaimer, the term of this patent is extended or adjusted under 35 U.S.C. 154(b) by 685 days.

(21) Appl. No.: 12/167,252

(22) Filed: Jul. 3, 2008

(65) Prior Publication Data

US 2010/0002430 A1 Jan. 7, 2010

(51) Int. Cl.
*F21S 4/00* (2006.01)
*F21V 21/00* (2006.01)

(52) U.S. Cl.
USPC ..... 362/249.02; 362/800

(58) Field of Classification Search
USPC ..... 362/249.01–249.02, 800
See application file for complete search history.

(56) References Cited

U.S. PATENT DOCUMENTS 3,213,751 A * 10/1965 Benjamin et al. ..... 359/592
5,027,258 A * 6/1991 Schoniger et al. ..... 362/629
5,276,591 A * 1/1994 Hegarty ..... 362/601
7,507,004 B2 * 3/2009 Chen ..... 362/373

FOREIGN PATENT DOCUMENTS

TW 255321 5/2006

* cited by examiner

*Primary Examiner* — Jason Moon Han
(74) *Attorney, Agent, or Firm* — Jianq Chyun IP Office

(57) ABSTRACT

An independently detachable light-emitting diode light source module adapted to be installed in a luminaire's casing having an opening and an accommodating cavity, is provided. The independently detachable light-emitting diode light source module includes an installing device, a light-emitting diode array, and a secondary optical light guide plate. The light-emitting diode array and the secondary optical light guide plate are disposed in the installing device. The light source module is disposed inside the accommodating cavity and is assembled in the luminaire's casing via the installing device, and the opening exposes the light-emitting diode light source module.

14 Claims, 4 Drawing Sheets

INDEPENDENTLY DETACHABLE LIGHT-EMITTING DIODE LIGHT SOURCE MODULE

BACKGROUND OF THE INVENTION

1. Field of the Invention

The present invention generally relates to a light source module, in particular, to an independently detachable light-emitting diode light source module.

2. Description of Related Art

All the conventional lamps, such as mercury lamps, incandescent lamps, and halogen lamps have defects of low efficiency, high power consumption, and high maintenance cost. Therefore, the conventional lamps are gradually replaced by light-emitting diode lamps.

Light-emitting diodes are semiconductor devices, and are mainly composed of semiconductor materials of III-V group element compounds. This semiconductor material has the characteristic of transforming electric energy into light based on the principle of combining electrons in the semiconductor material with holes to release excessive energy in form of light, thereby achieving the light-emitting effect.

The light-emitting of the light-emitting diodes is not realized by heating or discharging, but belongs to the cold light-emitting, so the lifespan of the light-emitting diode devices may be over 100,000 hours in the conditions of good heat dissipation, and the idling time is not required. In addition, the light-emitting diode devices have the advantages of rapid response time (about $10^{-9}$ seconds), small volume, small power consumption, low pollution (mercury free), high reliability, and suitable for mass production. Therefore, the light-emitting diode devices are widely applied in, for example, light sources of scanners, liquid crystal display's backlight, illumination of automobiles, traffic signs, and ordinary illumination devices. However, the light-emitting diodes still have the following defects in use.

1. The light generated by the light-emitting diodes has strong directivity, the undesired uniformity and glare make users uncomfortable.

2. The relative position of the conventional light-emitting diode light source and the lamp casing may affect the light distribution curve. Therefore, once the shape of the luminaire is changed, the overall optical design must be redesigned. Thus, elements such as the light-emitting diode light sources, the secondary optical devices, and the lamp casing cannot be altered freely, which increases the difficulty in product design.

3. The light-emitting diodes generate large amount of heat during operation, the brightness and lifespan of the light-emitting diodes are influenced by the operating temperature. Therefore, when the power of the light-emitting diode increases, the requirements on heat dissipation become stricter accordingly.

4. The conventional light-emitting diode light source is usually disposed in the lamp casing and uses the luminaire's casing to dissipate heat, and therefore the light-emitting diode light source and the luminaire's casing cannot be detached independently. Therefore, once the light-emitting diode light source failed required maintenance or replacement, the entire luminaire must be detached, which increases the operation difficulty and the maintenance cost.

SUMMARY OF THE INVENTION

The present invention is directed to an independently detachable light-emitting diode light source module, which is easy to maintain and performs preferred illumination effect.

As embodied and broadly described herein, the present invention provides an independently detachable light-emitting diode light source module, adapted to be installed in a luminaire's casing having an opening and an accommodating cavity. The independently detachable light-emitting diode light source module includes an installing device, a light-emitting diode array, and a secondary optical light guide plate. The light-emitting diode array and the secondary optical light guide plate are disposed in the installing device. The independently light-emitting diode light source module is disposed inside the accommodating cavity and is assembled in the luminaire's casing via the installing device, and the opening exposes the light source module.

In an embodiment of the present invention, the installing device includes a lamp box having a first light output end, the light-emitting diode array and the secondary optical light guide plate are disposed in the lamp box, and the secondary optical light guide plate is located at the first light output end.

In an embodiment of the present invention, the lamp box and the secondary optical light guide plate are integrally formed.

In an embodiment of the present invention, the installing device further includes a lampshade having a second light output end, the lampshade is disposed at the first light output end, and the secondary optical light guide plate is located between the lampshade and the light-emitting diode array.

In an embodiment of the present invention, the secondary optical light guide plate and the lampshade are integrally formed.

In an embodiment of the present invention, the lamp box, the lampshade, and the secondary optical light guide plate are integrally formed.

In an embodiment of the present invention, the independently detachable light-emitting diode light source module further includes an optical glass disposed between the first light output end and the second light output end.

In an embodiment of the present invention, the optical glass includes a prism sheet.

In an embodiment of the present invention, a material of the installing device is metal.

In an embodiment of the present invention, the installing device has a first fixing member, and the luminaire's casing has a second fixing member. The first fixing member and the second fixing member are engaged to fix the independently detachable light-emitting diode light source module in the luminaire's casing.

In an embodiment of the present invention, the light-emitting diode array includes a circuit board and at least one light-emitting diode light source. The light-emitting diode light source is disposed on the circuit board.

In an embodiment of the present invention, the light-emitting diode light source has a plurality of light-emitting diodes, and the light-emitting diodes are arranged along a first axis direction.

In an embodiment of the present invention, the secondary optical light guide plate has at least one slot and a plurality of light guide plates. The slot exposes the light-emitting diode light source, and the light guide plates are disposed at two sides of the slot.

In an embodiment of the present invention, the light guide plates are disposed asymmetrically along a second axis direction, and the second axis is perpendicular to the first axis.

In view of the above, the independently detachable light-emitting diode light source module of the present invention assembles the light-emitting diode light source as an independent component in the luminaire's casing, so as to achieve the quick detachment and assembly. Therefore, the detachable light-emitting diode light source module may be detached independently and conveniently for maintenance and replacement, and the installing device may be made of a material with high coefficient of thermal conductivity to be contributive to heat dissipation. In addition, the independently detachable light-emitting diode light source module of the present invention has the secondary optical light guide plate, and thus the illumination region of the light-emitting diode light source can be adjusted. Therefore, the illumination range and light pattern of the light-emitting diode light source can be controlled through the design of the secondary optical light guide plate, such that the independently detachable light-emitting diode light source module can be used in different environments. Moreover, the secondary optical light guide plate and the optical film may uniformize the light emitted by the light-emitting diode light source, and thus avoiding glare and achieve better illumination effect.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
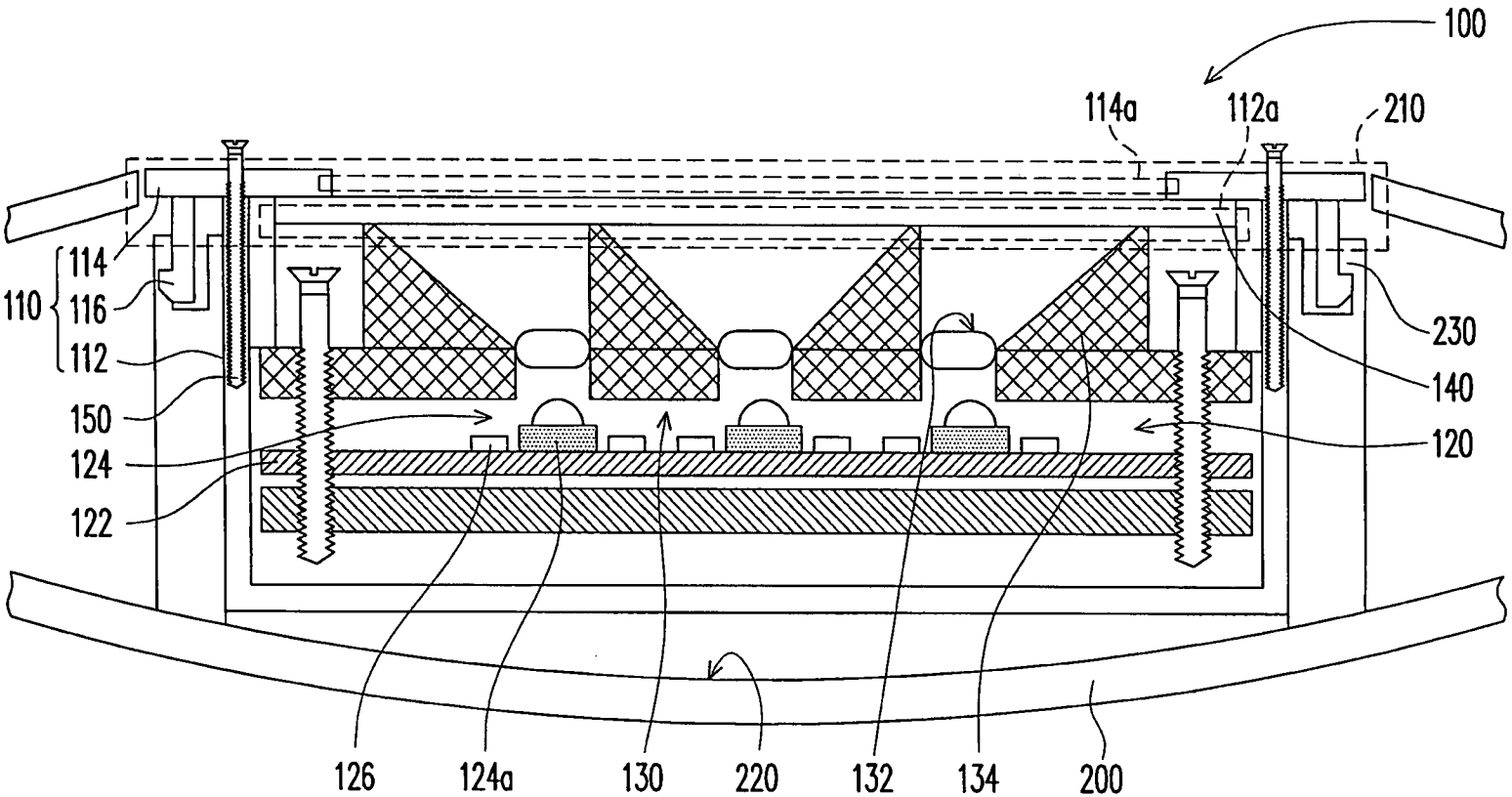
FIG. 1 is a schematic cross-sectional view of an independently detachable light-emitting diode light source module and a luminaire's casing according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a schematic cross-sectional view of an independently detachable light-emitting diode light source module according to an embodiment of the present invention. Referring to FIG. 1, the independently detachable light-emitting diode light source module 100 is adapted to be installed on a luminaire's casing 200, and the luminaire's casing 200 has an opening 210 and an accommodating cavity 220. The independently detachable light-emitting diode light source module 100 is disposed inside the accommodating cavity 220, and the opening 210 exposes the independently detachable light-emitting diode light source module 100. The independently detachable light-emitting diode light source module 100 includes an installing device 110, a light-emitting diode array 120, and a secondary optical light guide plate 130. The light-emitting diode array 120 and the secondary optical light guide plate 130 are assembled on the installing device 110, and the independently detachable light-emitting diode light source module 100 is assembled in the luminaire's casing 200 via the installing device 110.

The light-emitting diode array 120, for example, has a circuit board 122 and a plurality of light-emitting diode light sources 124. In addition, the circuit board 122 may provided with a plurality of circuit loop protection elements 126, for protecting the circuit loop connected with the light-emitting diode light source 124. The protection elements 126 are, for example, zener diodes.

In addition, the material of the installing device 110 is, for example, a material with high coefficient of thermal conductivity such as metal, such that the heat generated by the independently detachable light-emitting diode light source module 100 in operation may be successfully transferred to the luminaire's casing 200, and then dissipated to the outside. In addition, the installing device 110 may also have heatsink structures such as heatsink plates to facilitate the heat dissipation.

In this embodiment, the installing device 110 includes a lamp box 112 having a first light output end 112*a*. The light-emitting diode array 120 and the secondary optical light guide plate 130 are disposed in the installing device 110, and the secondary optical light guide plate 130 is located at the first light output end 112*a*. Moreover, the installing device 110 further includes a lampshade 114. The secondary optical light guide plate 130 is located between the lampshade 114 and the light-emitting diode array 120. The lampshade 114 has a second light output end 114*a*, such that the light emitted by the light-emitting diode array 120 exits through the first light output end 112*a* and the second light output end 114*a*. In addition, the independently detachable light-emitting diode light source module 100 further includes an optical film 140 disposed between the first light output end 112*a* and the second light output end 114*a*. The optical film 140 is, for example, a prism sheet, for uniformizing the light.

In this embodiment, the lampshade 114 is, for example, locked on the lamp box 112 by a plurality of screws 150. It should be noted that in this embodiment, the lamp box 112, the lampshade 114, and the secondary optical light guide plate 130 are independent elements, but may also be integrally formed. For example, the lamp box 112 and the lampshade 114 may be integrally formed. Or, the lampshade 114 and the secondary optical light guide plate 130 may be integrally formed. Or, the lamp box 112 and the secondary optical light guide plate 130 may be integrally formed. Or, the lamp box 112, the lampshade 114, and the secondary optical light guide plate 130 are integrally formed.

In addition, the installing device 110 has a first fixing member 116, and the luminaire's casing 200 has a second fixing member 230. The first fixing member 116 and the second fixing member 230 are engaged to fix the independently detachable light-emitting diode light source module 100 in the luminaire's casing 200. For example, the first fixing member 116 may be a hook, and the second fixing member 230 has a slot. The first fixing member 116 passes through the second fixing member 230 to fix the independently detachable light-emitting diode light source module 100 in the luminaire's casing 200.

It should be noted that although a plurality of light-emitting diode light sources 124 is taken as an example in this embodiment, in an embodiment (not shown) of the present invention, only one light-emitting diode light source may be disposed, and the present invention is not limited thereto.

Since the installing device 110, the light-emitting diode array 120, and the secondary optical light guide plate 130 are assembled with in the luminaire's casing 200 in the form of the independently detachable light-emitting diode light source module 100, the independently detachable light-emitting diode light source module 100 has the advantage of easy detachment, which brings convenience to the maintenance and replacement of the circuit board 122, the light-emitting diode light source 124, and the secondary optical light guide plate 130. Furthermore, the installing device 110 may be made of a material of high coefficient of thermal conductivity such as metal, such that the heat dissipation effect of the independently detachable light-emitting diode light source module 100 is improved.

Figure 2:
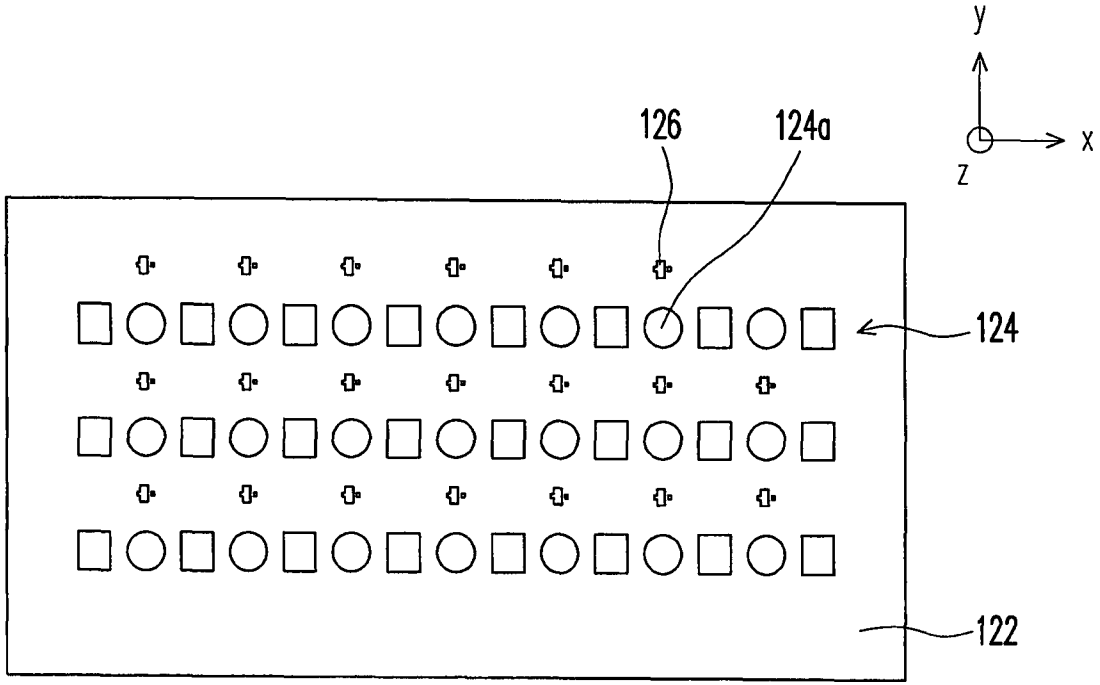
FIG. 2 is a schematic view illustrating arrangement of the light-emitting diode light source in FIG. 1 on a circuit board.

FIG. 2 is a schematic view illustrating arrangement of the light-emitting diode light sources in FIG. 1 on the circuit board. Referring to FIGS. 1 and 2, in this embodiment, the light-emitting diode light source 124 includes, for example, a plurality of light-emitting diodes 124*a*, and the light-emitting diodes 124*a* are arranged along a first axis x. The secondary optical light guide plate 130 has a plurality of slots 132 disposed corresponding to the light-emitting diode light source 124, and a plurality of light guide plates 134 extending along the first axis x are disposed at two sides of the slots 132. The light radiated by the light-emitting diode light source 124 exits through the slots 132, reflected by the light guide plates 134, and then exits through the opening 210 of the luminaire's casing 200.

The direction of the light emitted by the light-emitting diode light source 124 may be controlled through the design of the light guide plates 134, so as to control the illumination range and light pattern of the independently detachable light-emitting diode light source module 100, and thus the independently detachable light-emitting diode light source module 100 may be applied in different environments. Moreover, the secondary optical light guide plate 130 also has the effect of uniformizing the light emitted by the light-emitting diode light source 124, and has the function of preventing glare, thereby achieving better illumination effect.

In detail, three axes, namely a first axis x, a second axis y, and a third axis z, are set to be perpendicular to one another, and the light guide plates extend along the first axis x and are arranged along the second axis y. The arrangement positions and heights of the light guide plates may satisfy the following equations.

$$Y - Y_0 = \sum_{n=0}^{N} a_n (Z - Z_0)^n \quad (1)$$

$$Y - Y_0 = \sum_{n=0}^{M} b_n (Z - Z_0)^n \quad (2)$$

$Y_0$ indicates the position of the light-emitting diode light source at the second axis y. $Z_0$ indicates the position of the light-emitting diode light source at the third axis z. Y indicates the position of the light guide plates at the second axis y. Z indicates the height of the light guide plates at the third axis z. $a_n$ and $b_n$ are coefficients, and N and M are numbers of terms. In this embodiment, formula (1) and formula (2) may be used to dispose the light guide plates at two sides of the light-emitting diode light source. That is to say, those skilled in the art may adjust $a_n$, $b_n$, N, and M at will, so as to make the illumination light pattern of the independently detachable light-emitting diode light source module meet the requirements of different environments. In addition, the shape of the light guide plates is not limited to the shape as shown in FIG. 2. The light guide plates may have different shapes according to different environments, for example, the light guide plates may be designed to be curved.

Figure 3:
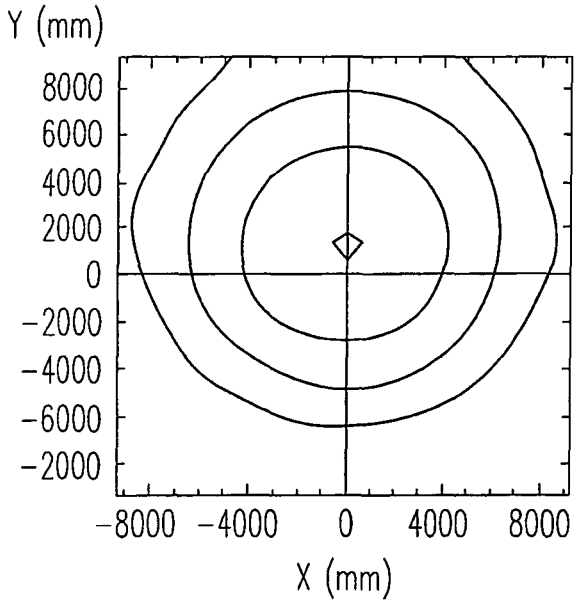
FIG. 3 is a light intensity distribution diagram of an independently detachable light-emitting diode light source module without the secondary optical light guide plate.
Figure 4:
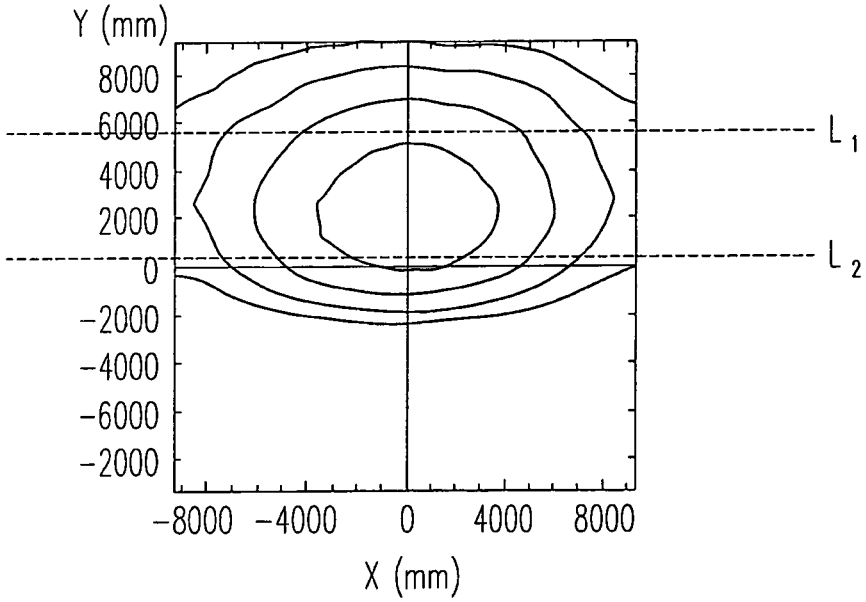
FIG. 4 is a light intensity distribution diagram of the independently detachable light-emitting diode light source module according to an embodiment of the present invention.

The application of the independently detachable light-emitting diode light source module of the present invention in a street lamp is taken as an example for illustration. FIG. 3 is a light intensity distribution diagram of an independently detachable light-emitting diode light source module without the secondary optical light guide plate. FIG. 4 is a light intensity distribution diagram of an independently detachable light-emitting diode light source module according to an embodiment of the present invention. Table 1 shows light intensity distribution values of the independently detachable light-emitting diode light source module in FIG. 3, and Table 2 is a light intensity distribution diagram of the independently detachable light-emitting diode light source module in FIG. 4. Referring to FIGS. 3 and 4, Table 1, and Table 2, in the environment of FIG. 3 and FIG. 4, for example, a road width is set to be 6 m, a lamp-post arm is set to be 66 cm, and an elevation of the independently detachable light-emitting diode light source module is set to be 14 degrees. The first axis x is set to be a travelling direction, the second axis y is set to be a road width direction, and the third axis z is a direction perpendicular to the road surface.

TABLE 1

| Y(mm) | X(mm) | Light intensity |
|---|---|---|
| 6000.0000 | 9000.000 | 1.65220 |
| 0.000000 | 9000.000 | 1.309228 |
| 6000.000 | −9000.000 | 1.070086 |
| 0.000000 | −9000.000 | 1.278767 |

TABLE 2

| Y(mm) | X(mm) | Light intensity |
|---|---|---|
| 6000.0000 | 9000.000 | 1.856652 |
| 0.000000 | 9000.000 | 1.727982 |
| 6000.000 | −9000.000 | 1.945574 |
| 0.000000 | −9000.000 | 1.742406 |

The street lamp is disposed at one side of the road, and an ideal light pattern thereof extends along the first axis x. Thus, the light guide plates may be disposed along the second axis y in an asymmetrically curved surface, so as to reflect the light diffused to the second axis y, such that the light emitted by the independently detachable light-emitting diode light source module is concentrated along the second axis y, and shifts towards the positive direction of the second axis y. That is to say, M and N are set to be different, and $a_n$ and $b_n$ are set to be different, so as to dispose the light guide plates in an asymmetrically curved surface. It can be seen from FIG. 3 and FIG. 4 that the light guide plates make the light to be concentrated in a road width boundary L1 and a road width boundary L2, thus achieving better illumination effect.

In view of the above, the present invention at least has the following advantages.

1. The circuit board, the light-emitting diode light source, the secondary optical light guide plate, and the installing device are installed in the luminaire's casing in the form of a light source module, and the independently detachable light-emitting diode light source module has the advantage of easy detachment. Therefore, the maintenance and replacement of the circuit board, the light-emitting diode light source, and the secondary optical light guide plate become more convenient.

2. The installing device is made of a material of high coefficient of thermal conductivity such as metal, such that the heat dissipation effect of the independently detachable light-emitting diode light source module is improved.

3. The direction of the light emitted by the light-emitting diode light source may be controlled through the design of the light guide plates, so as to control the illumination range and light pattern of the independently detachable light-emitting diode light source module, and thus the independently detachable light-emitting diode light source module may be applied in different environments.

4. The secondary optical light guide plate has the effect of uniformizing the light emitted by the light-emitting diode light source, and has the function of preventing glare, thus achieving better illumination effect.

5. An optical film is provided between the first light output end and the first light output end, so as to achieve the dust-proof and moisture-proof effects of the light-emitting diode light source, and further uniformize the light emitted by the light-emitting diode light source, thereby achieving better illumination effect.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An independently detachable light-emitting diode light source module, adapted to be installed in a luminaire's casing having an opening and an accommodating cavity, comprising:

an installing device;

a light-emitting diode array having at least one light-emitting diode light source, disposed in the installing device; and a secondary optical light guide plate, disposed in the installing device, wherein the secondary optical light guide plate comprises:

a plurality of slots, each exposing the at least one light-emitting diode light source, wherein a light emitted by the at least one light-emitting diode light source passes through the slot; and a plurality of light guide plates, disposed at two sides of each slot, wherein each of the light guide plates has a reflective planar surface so as to reflect the light emitted by the at least one light-emitting diode light source toward the opening of the luminaire's casing, and normal vectors of any two adjacent reflective planar surfaces are not parallel, wherein the light-emitting diode light source module is disposed in the accommodating cavity of the luminaire's casing, and the light-emitting diode light source module is linked up or detached with the luminaire's casing by using the installing device, the opening of the luminaire's casing exposes the independently detachable light-emitting diode light source module, wherein the installing device, the light-emitting diode array and the secondary optical light guide plate are integrated into a unit, and the unit is assembled with the luminaire's casing independently and detachably.

2. The independently detachable light-emitting diode light source module according to claim 1, wherein the light-emitting diode array further comprises a circuit board, and the at least one light-emitting diode light source is disposed on the circuit board.

3. The independently detachable light-emitting diode light source module according to claim 1, wherein the light-emitting diode light source comprises a plurality of light-emitting diodes, and the light-emitting diodes are arranged along a first axis direction.

4. The independently detachable light-emitting diode light source module according to claim 3, wherein the light guide plates are disposed along a second axis direction, the second axis is perpendicular to the first axis, and illumination range of an illuminated object and a light intensity distribution curve are controlled by designs of amount, shape, angle, and position of the light guide plates.

5. The independently detachable light-emitting diode light source module according to claim 1, wherein the installing device comprises:

a lamp box, comprising a first light output end, wherein the light-emitting diode array and the secondary optical light guide plate are disposed in the lamp box, and the secondary optical light guide plate is located at the first light output end.

6. The independently detachable light-emitting diode light source module according to claim 5, wherein the lamp box and the secondary optical light guide plate are integrally formed.

7. The independently detachable light-emitting diode light source module according to claim 5, wherein the installing device further comprises:

a lampshade, comprising a second light output end, wherein the lampshade is disposed at the first light output end, and the secondary optical light guide plate is located between the lampshade and the light-emitting diode array.

8. The independently detachable light-emitting diode light source module according to claim 7, wherein the secondary optical light guide plate and the lampshade are integrally formed.

9. The independently detachable light-emitting diode light source module according to claim 7, wherein the lamp box, the lampshade, and the secondary optical light guide plate are integrally formed.

10. The independently detachable light-emitting diode light source module according to claim 7, further comprising an optical glass disposed between the first light output end and the second light output end.

11. The independently detachable light-emitting diode light source module according to claim 10, the optical glass comprises a prism sheet.

12. The independently detachable light-emitting diode light source module according to claim 1, wherein a material of the installing device is metal.

13. The independently detachable light-emitting diode light source module according to claim 1, wherein the installing device comprises a first fixing member, the luminary comprises a second fixing member, and the first fixing member and the second fixing member are engaged to fix the independently detachable light-emitting diode light source module into the luminaire's casing.

14. An independently detachable light-emitting diode light source module, adapted to be installed in a luminaire's casing having a slot, an opening and an accommodating cavity, the independently detachable light-emitting diode light source module comprising:

an installing device having at least one hook;

a light-emitting diode array having at least one light-emitting diode light source, disposed in the installing device; and a secondary optical light guide plate, disposed in the installing device, wherein the secondary optical light guide plate comprises:

a plurality of slots, each exposing the at least one light-emitting diode light source, wherein a light emitted by the at least one light-emitting diode light source passes through the slot; and a plurality of light guide plates, disposed at two sides of each slot, wherein each of the light guide plates has a reflective planar surface so as to reflect the light emitted by the at least one light-emitting diode light source toward the opening of the luminaire's casing, and normal vectors of any two adjacent reflective planar surfaces are not parallel, wherein the light-emitting diode light source module is disposed in the accommodating cavity of the luminaire's casing, and the opening of the luminaire's casing exposes the independently detachable light-emitting diode light source module, wherein the installing device, the light-emitting diode array and the secondary optical light guide plate are integrated into a unit, and the unit is assembled with the luminaire's casing independently and detachably by means of engaging the at least one hook of the installing device into the slot of the luminaire's casing.

* * * * *